US007168706B2

(12) United States Patent
Pierce et al.

(10) Patent No.: US 7,168,706 B2
(45) Date of Patent: Jan. 30, 2007

(54) ARCADE GAME

(76) Inventors: Jeffrey Pierce, 1031 S. Beloit, Forest Park, IL (US) 60130; Harold Skripsky, 353 Prairie Knoll Dr., Naperville, IL (US) 60565; Lyle Willimann, 430 D. James Ct., Glendale Heights, IL (US) 60139

( * ) Notice: Subject to any disclaimer, the term of this patent is extended or adjusted under 35 U.S.C. 154(b) by 531 days.

(21) Appl. No.: 10/635,967

(22) Filed: Aug. 7, 2003

(65) Prior Publication Data

US 2004/0077427 A1 Apr. 22, 2004

Related U.S. Application Data

(60) Provisional application No. 60/402,196, filed on Aug. 9, 2002.

(51) Int. Cl.
*A63F 9/00* (2006.01)

(52) U.S. Cl. ..... 273/448; 273/355; 463/7

(58) Field of Classification Search ..... 273/447–448, 273/108, 356, 357; 463/2, 5, 7; 473/447
See application file for complete search history.

(56) References Cited

U.S. PATENT DOCUMENTS 4,583,743 A * 4/1986 Macek ..... 273/368
5,344,156 A * 9/1994 Levin ..... 273/355
5,397,134 A * 3/1995 Fishman et al. ..... 463/25
5,417,435 A * 5/1995 Peretz ..... 273/355
5,435,570 A * 7/1995 Labrasseur ..... 273/355
5,513,853 A * 5/1996 Crompton et al. ..... 273/448
5,527,044 A * 6/1996 Lee et al. ..... 273/448
5,851,012 A * 12/1998 Langieri et al. ..... 273/317.1
6,634,940 B2 * 10/2003 Yoshida et al. ..... 463/7
6,889,678 B1 * 5/2005 Oltmann ..... 124/7
6,899,337 B2 * 5/2005 Fisher et al. ..... 273/447

* cited by examiner

*Primary Examiner*—John M. Hotaling, II
*Assistant Examiner*—Alex F. R. P. Rada, II
(74) *Attorney, Agent, or Firm*—Welsh & Katz, Ltd.

(57) ABSTRACT

The game apparatus has: a rotating bin containing at least one game piece; a moveable claw for grabbing the at least one game piece; a catapult for launching the at least one game piece; and a target area for receiving the at least one game piece; wherein the moveable claw places the at least one game piece on the catapult, and wherein the catapult launches the at least one game piece at the target area. The method of playing the game having a plurality of game pieces and having a target area, has the steps of: selecting at least one of the game pieces at a first location; moving the selected game piece to a second location; and catapulting the at least one of the game pieces from the second location toward a target area. The step of selecting may have the steps of rotating a plurality of game pieces, selectively stopping rotation of the plurality of game pieces, and picking up at least one of the game pieces. The step of catapulting may have the steps of aiming the catapult toward a target area and launching the at least one of the game pieces toward the target area.

27 Claims, 9 Drawing Sheets

ARCADE GAME

FIELD OF THE INVENTION

The present invention relates in general to arcade games, and in particular, to coin or token redemption games.

BACKGROUND

One type of arcade game that is popular in family amusement centers around the country is the redemption game. A redemption game in one in which the player is awarded with tickets, tokens or other items redeemable for prizes. Such prizes are typically displayed at a central location, and are given to players who collect enough tickets to redeem them for a desired prize. Such games, and the prizes associated with them, are commonly seen in locations such as family amusement centers and in pizza restaurants oriented toward children. A problem with the redemption game is the lack of excitement associated with winning tickets, tokens or other items redeemable for prizes. It is less exciting to win a paper stub than an actual item. Thus, players may be lured to seek excitement elsewhere, resulting in lost revenue for the owner of the redemption game. Another problem is the need to set up and administer an area for redemption of tickets or tokens for gifts. A person must be present to monitor the goods and to perform the redemption, and storage space for the goods is required. Another problem is the potential for counterfeiting tickets, or passing off tickets from other sources as those redeemable for goods. The tickets dispensed from the redemption game typically do not contain security features, rendering them liable to counterfeiting. Further, inattention or carelessness of the attendant can allow other types of tickets to be passed off as redeemable ones, allowing an unscrupulous player to obtain a higher-value item than he or she is legitimately entitled to.

In an attempt to overcome the problems of redemption games, prize games were introduced, which dispense prizes directly from the game machine itself. Typically, such machines include a game of skill wherein the player controls some aspect of the game, such as the apparent motion of a light around a circle of light bulbs, or the motion of a coin through the apparatus. The player selects a location to stop the apparent motion of the light with a controller switch, and wins the prize, if any, corresponding to the selected final location of the light. One problem with this prize game is that the difficulty level is uniform across the prizes, and is therefore not proportional to the value of the prize. Thus, a player may be as likely to win a low-value prize, such as an eraser or gum, as a high-value value prize, such as a portable radio or disposable camera. This may be frustrating to the player, who would prefer to play for a high-value prize, and for the owner of the machine, who is substantially as likely to give away high-value items as low-value ones. The owner may attempt to compensate by inserting more low-value prizes into the machine; however, a machine filled with low-value prizes is less likely to attract players, and thus less likely to generate revenue for the owner.

Another problem with known prize games is the lack of visibility into the difficulty level by the player. The difficulty level is typically invisible to the player before he or she begins play, and may remain invisible to the player even during and after play. For example, in some known prize games involving moving lights in a pattern of light bulbs, the light always moves at substantially the same speed. As the light moves in front of the prize, the player attempts to stop the light and win the prize. Because the light moves at substantially the same speed at all times, it is in front of the prize for a fixed amount of time; for example, 100 milliseconds. However, it is known to adjust the difficulty level of the game by providing a time less than the time the light is in front of the prize in which the player must select the light. For example, if the light is in front of the prize from 100 milliseconds, the game machine may be set to allow the light to continue past the prize unless the player stops the light in 70 milliseconds, or 50 milliseconds, or another time period less than 100 milliseconds which is preset by the owner of the machine. The player never has any visibility into the source of the difficulty, and may eventually grow disenchanted with the prize game, as the player never understands why he or she always seems to lose, and has no idea how to improve his or her skills at the prize game.

While the present invention is susceptible of embodiments in various forms, there is shown in the drawings and will hereinafter be described some exemplary and non-limiting embodiments, with the understanding that the present disclosure is to be considered an exemplification of the invention and is not intended to limit the invention to the specific embodiments illustrated.

In this disclosure, the use of the disjunctive is intended to include the conjunctive. The use of the definite article or indefinite article is not intended to indicate cardinality. In particular, a reference to "the" object or "a" object is intended to denote also one of a possible plurality of such objects.

BRIEF DESCRIPTION OF THE DRAWINGS

The features of the present invention, which are believed to be novel, are set forth with particularity in the appended claims. The invention may best be understood by reference to the following description taken in conjunction with the accompanying drawings, in the several figures of which like reference numerals identify like elements, and in which:

DETAILED DESCRIPTION

Figure 1:
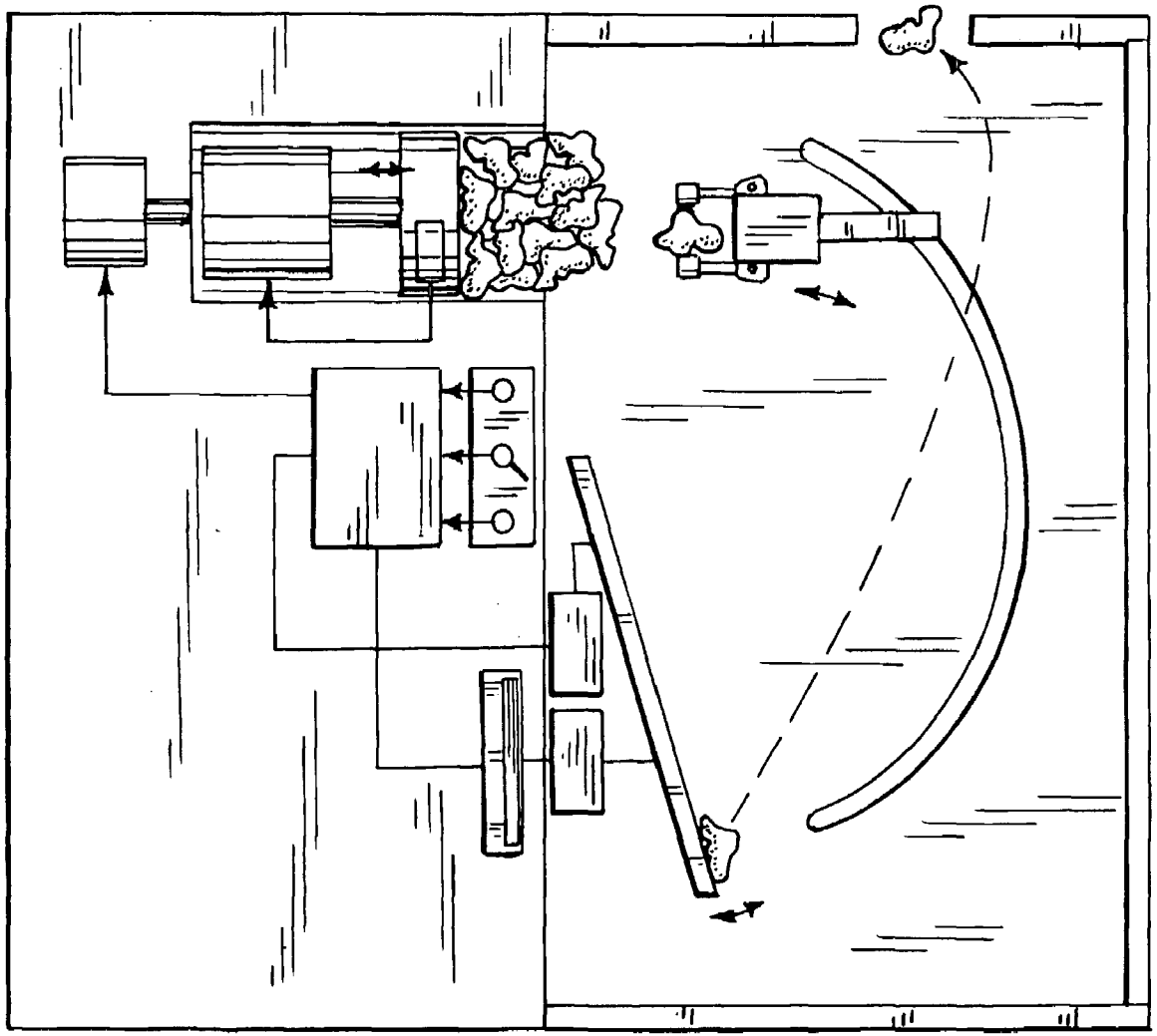
FIG. 1 is a general diagram of one embodiment of the arcade game.
Figure 2A:
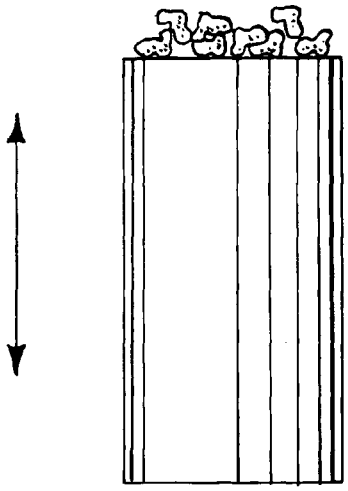
FIG. 2*a*, 2*b* and 2*c* depict components of the FIG. 1 game.
Figure 2C:
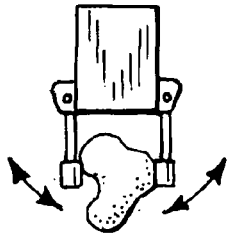
Figure 2B:
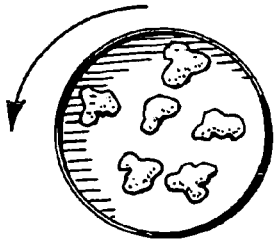
Figure 3:
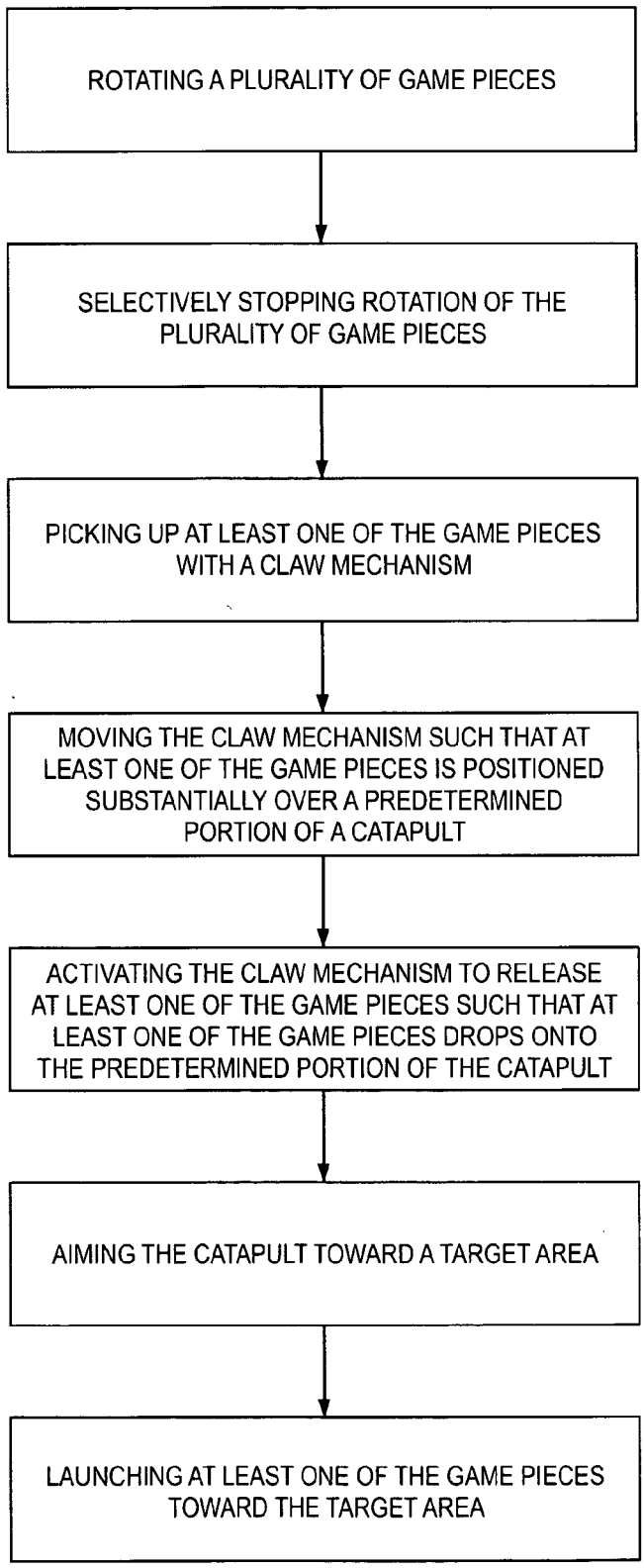
FIG. 3 is a flow diagram of the steps of playing the arcade game.
Figure 4:
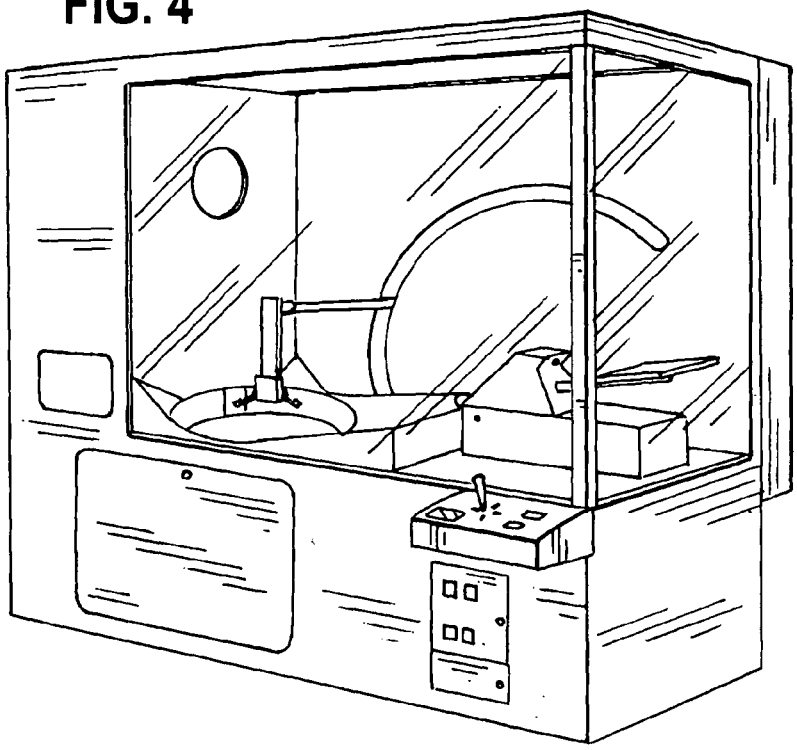
FIGS. 4–9 depict various aspects of the arcade game.
Figure 5:
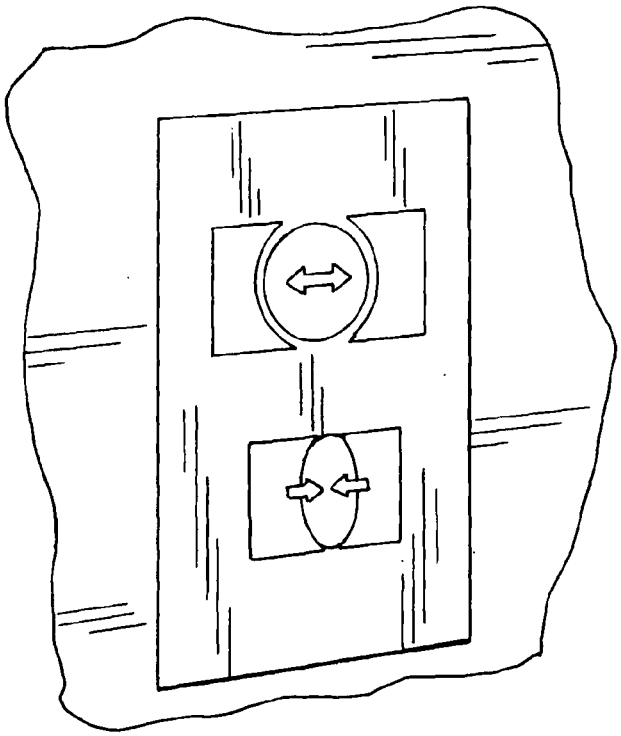
Figure 6:
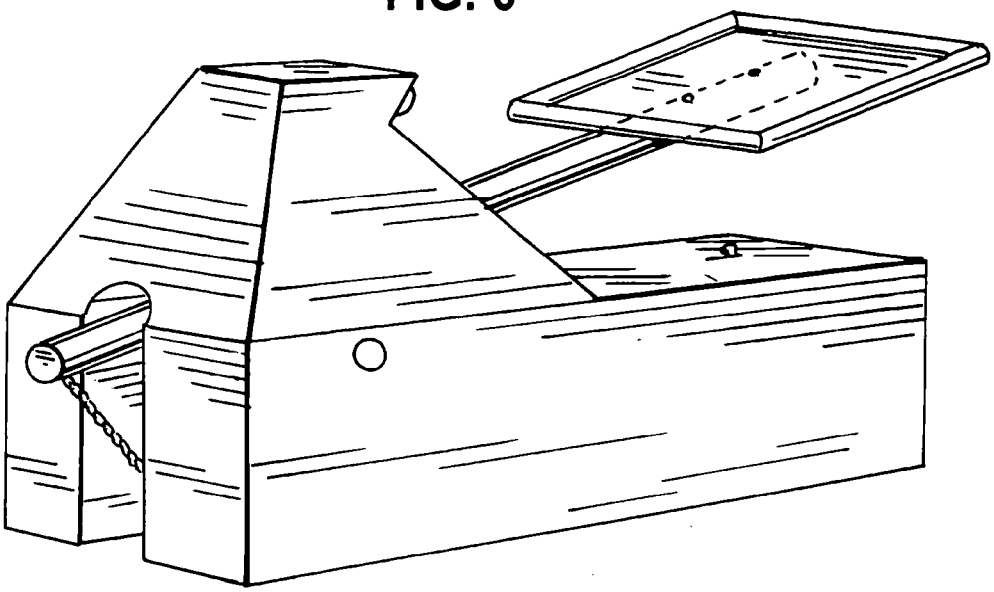
Figure 7:
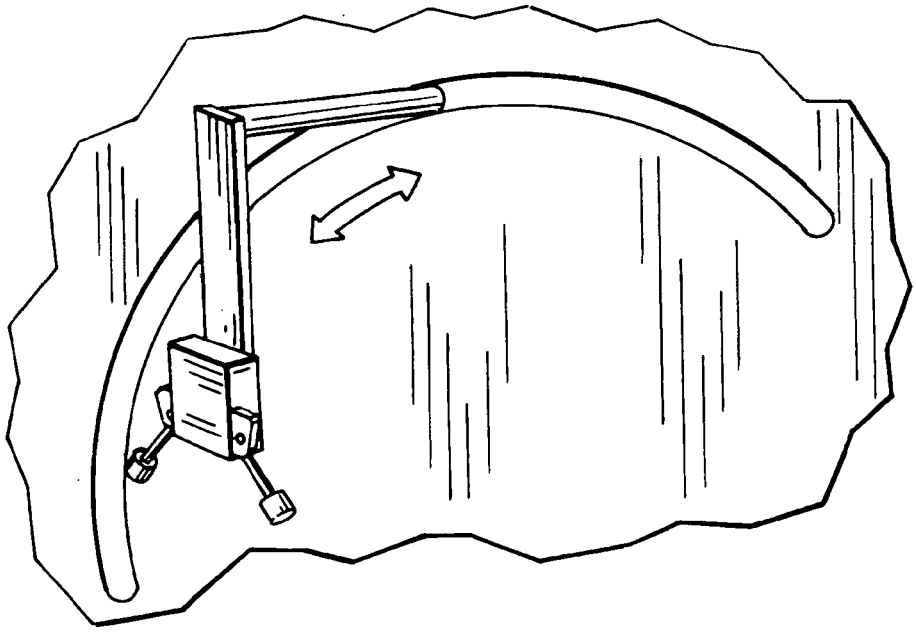
Figure 8:
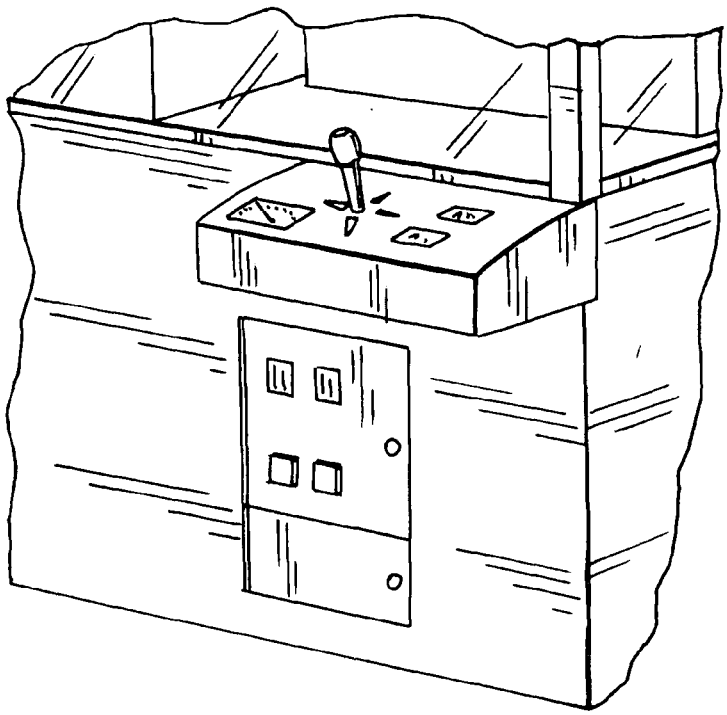
Figure 9:
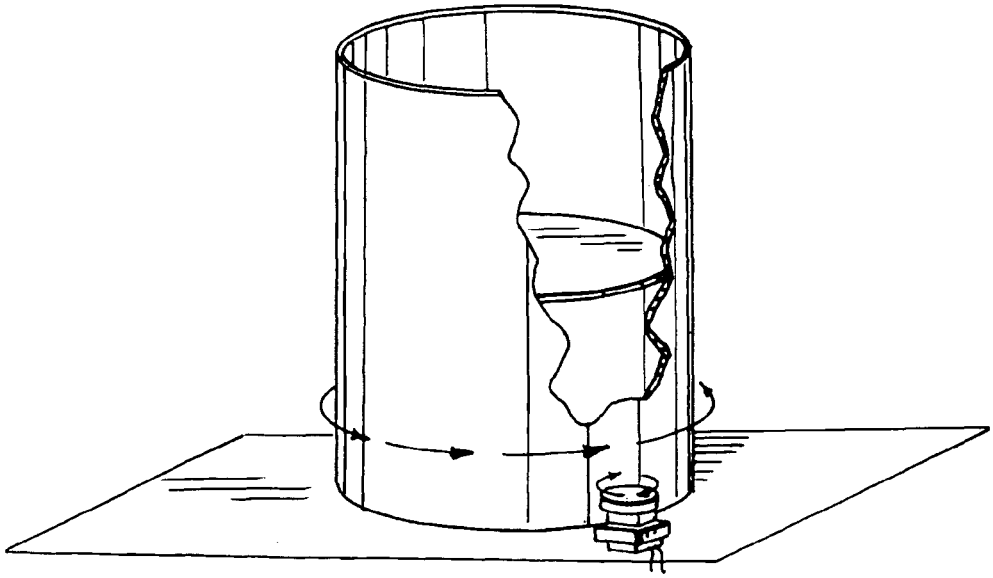
Figure 10:
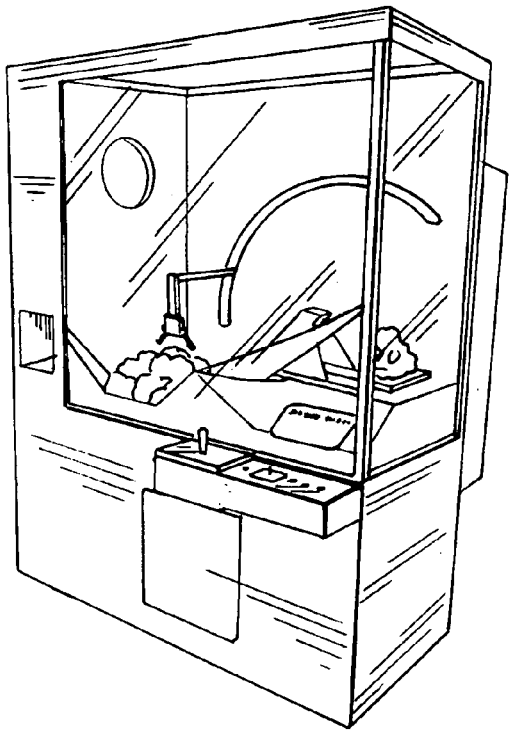
FIGS. 10–16 are depictions of various portions of the arcade game.
Figure 11:
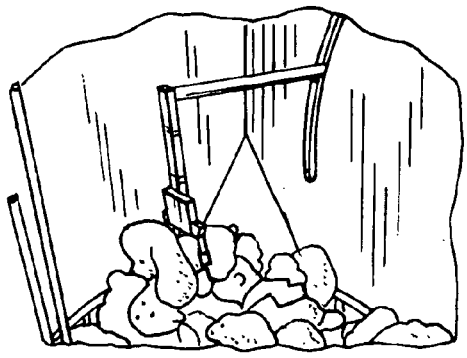
Figure 12:
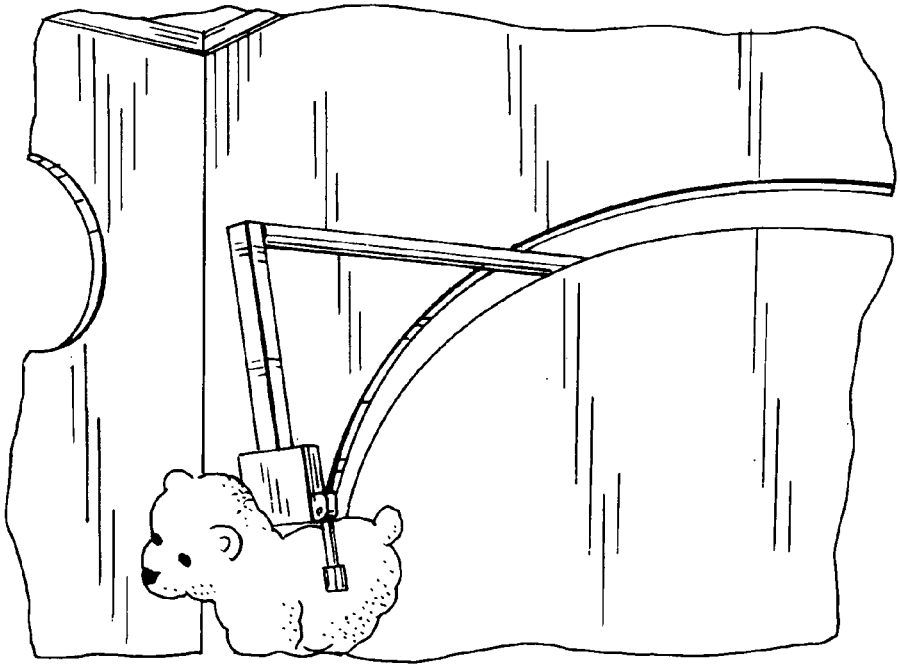
Figure 13:
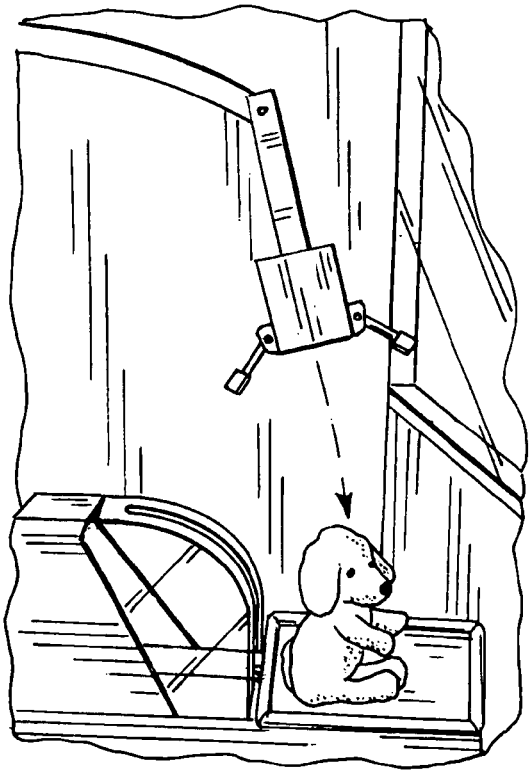
Figure 14:
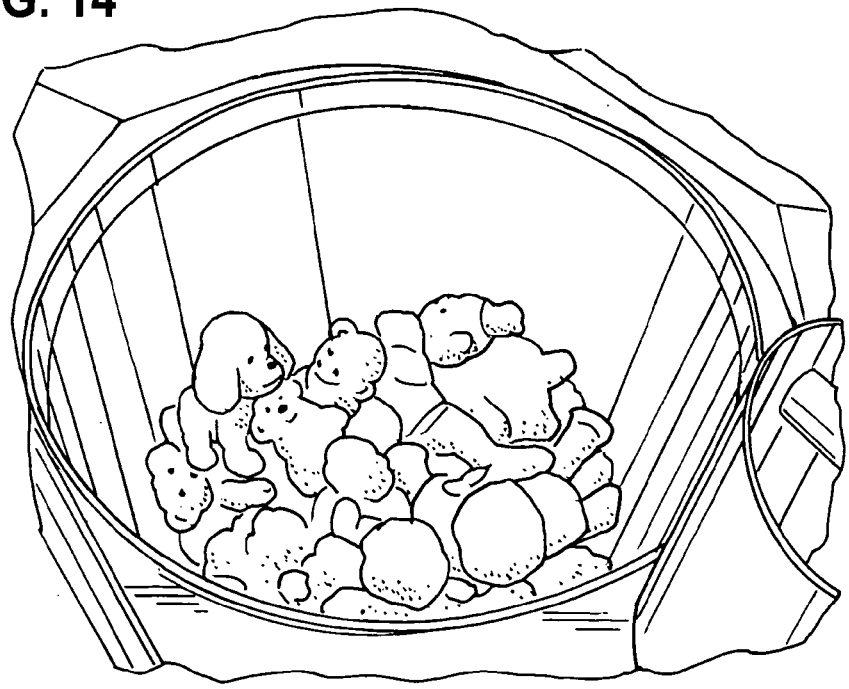
Figure 15:
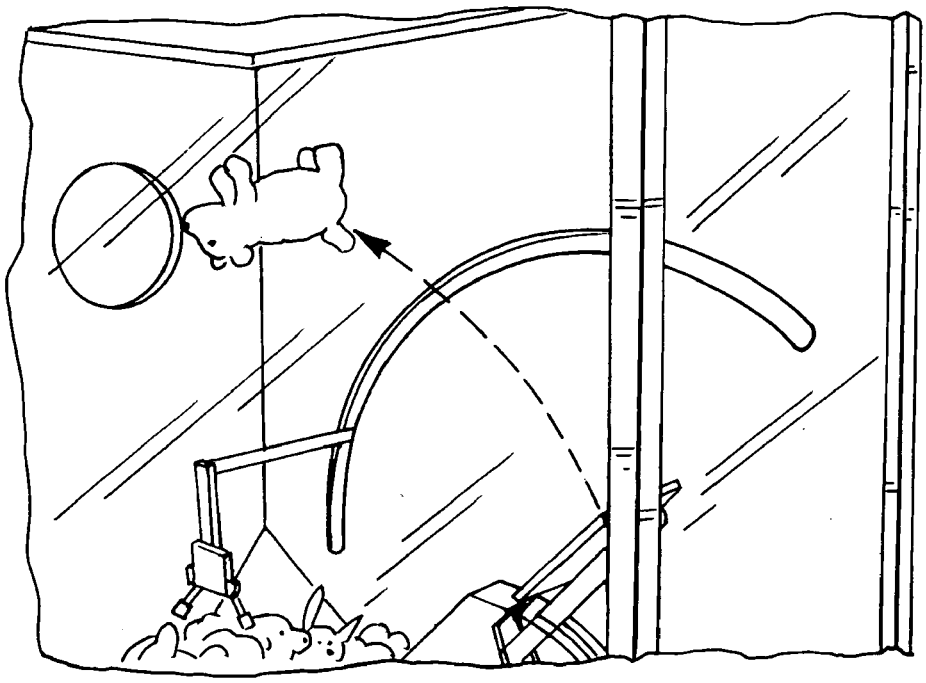
Figure 16:
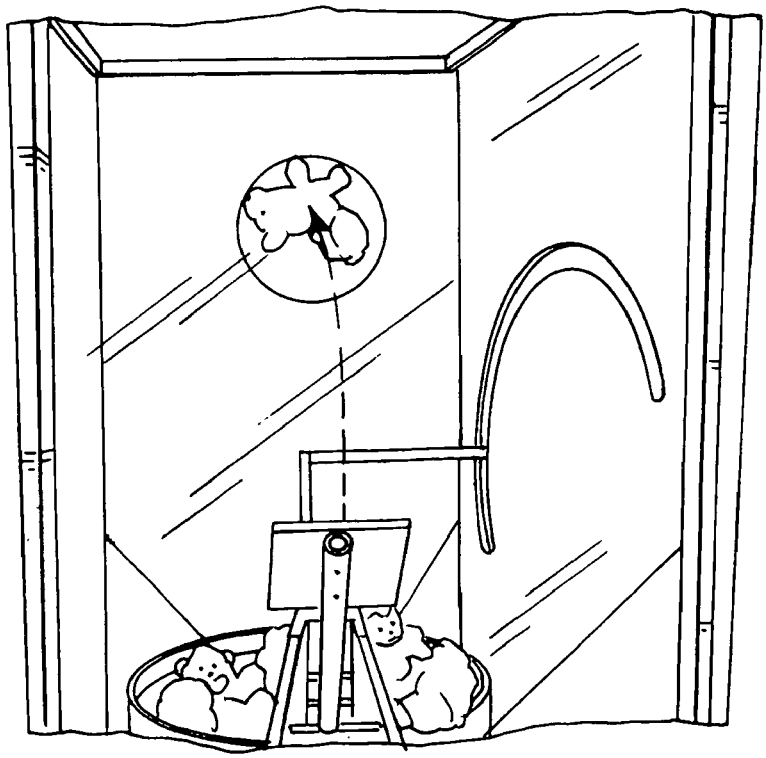

Object of the Game:

Using a catapult like launcher, the player attempts to accurately launch a prize, thru the air, across the game, and into a target opening. If the player is successful in projecting the prize thru the target opening, the item instantly falls to a prize door and is awarded to the player.

Play:

The player control panel consists of four control pieces:

1. Load button
2. Launch button
3. Aiming Joystick
4. Strength Meter. The strength meter consists of a light bar that oscillates back and forth indicating the strength of the launch. When the light is illuminated at the far most Strong side the launch is at its hardest, when the light is illuminated at the far most Weak side, the launch is at its softest.

Once a player credits up the game, the prize bin will automatically begin to rotate and the Load button begins to flash. The player will then push the load button causing the bin to stop rotating, the claw to dip into the bin, and a prize to be caught in the grasp of the claw. The claw will then automatically carry the prize over to the Catapult, drop the prize accurately onto the catapults launching arm, and return back to its home position. If the launching arm doesn't sense a prize, it will repeat the process until an item is actually dropped on the launching arm. The player is always guaranteed one launch per credit.

Once the launching arm senses a loaded prize, it activates the oscillating strength meter and Illuminates the flashing "Launch" button. The player has two skill adjustments available for them if they choose. The first is a joystick allows the player to aim the launch in the desired left/right direction. Next adjustment is the strength of the launch so that the prize projects in the proper trajectory. Using both or none, the player will press the launch button to activate the catapult. If the player is unsuccessful in launching the prize thru the target opening, the prize itself will fall back into the prize bin, and await the next play.

Vision:

To some players, typical crane games have a reputation for being a "Rip Off. By creating a game that always 100% of the time grabs a piece of plush, we hope to eliminate that "Rip Off" feeling. Once that piece of plush is in the claws grasp, the player gets a feeling of already being half way home. People walking by will see a piece of plush in the claws grasp and immediately stop to watch. It makes the win appear to be obtainable. People are so used to seeing crane claws return empty, it will shock them. Players will not feel like they are in the mercy of the claws, they will feel like its up to them. That . . . Oooh just missed! feeling is a guarantee.

Using two different sized cabinets this game can be operated in both FEC/AEC/CEC markets and on the street. The street would require a smaller sized cabinet where the plush item could be launched more vertical than Horizontal. Using different sized claws the product could be interchanged from Plush to sports balls (mini basketballs, footballs, soccer balls, etc) to Hardline goods contained in capsules.

The game includes a self-loading product bin. As players win product, the bin will automatically raise itself so that the remaining product rests at a predetermined height. The prizes are being picked up and dropped in conjunction with the rotating bin. All of this utilized together causes the bin to always appear full and fluffed. It needs no attention until the prizes have been completely depleted. Its self-maintaining, especially for a street operator.

Product Selection:

Original concept was to contain an assortment of feline plush such as Kitty cats, tigers, leopards, etc, hence the Name CAT-A-PULTZ. In one embodiment a random assortment of Medium sized plush was used.

Game difficulty is increased with assorted shaped and weighted pieces. The player must judge the weight by visual inspection to determine the proper strength to launch the item. By loading the bin with assorted pieces, the flight pattern changes with every launch.

Percentaging:

Percentaging can be adjusted in a few ways:

1. The operator can adjust the maximum and minimum of the launch strength. Stronger launches tend to be more accurate than weaker ones. The weight of the selected prizes will determine what setting to adjust it to.
2. The size target opening can be adjusted to change the difficulty. The game base opening is fairly large so that it accommodates the larger sized prizes. Using inserts with various sizes openings the operator can insert the proper size target of preference. Its as easy as pulling one size out and inserting another. This will allow the operator a greater range of freedom to work with popular product.

Additions:

1. The target opening itself can be made as a moving target.
2. The target opening could contain a blocker that moves back and forth in front of the opening. This will cause the player to have to time the shot to bypass the blocker. Like a goalie at a goal.
3. For a sports theme, a basketball backboard and rim can be used as the target itself The item will hit the backboard and fall into the net for a win. A goalie and a net can be used for hockey and soccer themed games.

Game Features

Number of pieces of plush used Depends on the size product the operator decides to use. Currently anticipate are 60–70 pieces of Medium sized plush. Currently the cabinet contains room for storage underneath Plush sustains almost no Damage. Game may also have a slightly padded back wall to assist with the impact. Especially if Hard line goods are used, a softer impact wall would be needed. Some wear damage to the plush could be caused by the edges of the rotating bin. Using a molded rim cap around the bin should completely eliminate that wear.

If two pieces of plush are grabbed, player thinks he has a great advantage, but in reality it makes the play that much more difficult. Two pieces of plush now tend to occupy the launching arm. Neither of them will launch very straight. The skillful player will have to anticipate the flight pattern and adjust using the aiming joystick.

In this embodiment this game cannot percentage itself. But, by having a square target opening, the game could use a motor to automatically move a false back wall, to adjust the size of the target opening. The sides would condense leaving a smaller target opening or expand for a larger one. That way if the game senses too high of a payout, the game can be programmed to automatically adjust the opening for a more difficult target. This would automatically happen between games, never during play.

A prize may be selected. The prize bin is rotating until the player hits the LOAD button. When the button is pressed the bin will stop rotating and the claw will grab the prize located directly below it. The player can time the LOAD button to be pressed right at the point their prize of choice is directly underneath the claw. If the player timed it correctly the claw will pick up that prize of choice for a shot at winning it.

In general the game apparatus, comprises: a rotating bin containing at least one game piece; a moveable claw for grabbing the at least one game piece; a catapult for launching the at least one game piece; and a target area for receiving the at least one game piece; wherein the moveable claw places the at least one game piece on the catapult, and wherein the catapult launches the at least one game piece at the target area.

In one embodiment the game apparatus for use with at least one game piece and a target area, comprises: means for containing the at least one game piece; means for at least rotating the means for containing; means for grabbing the at least one game piece; means for catapulting the at least one game piece toward the target area; means for moving the means for grabbing from the means for containing to the means for catapulting; means for activating the means for grabbing such that the at least one game piece is released onto the catapult; and means for positioning the means for catapulting and means for activating the catapult such that the at least one game piece is catapulted toward the target area.

An embodiment of a skill game apparatus, comprises: a self-loading bin containing at least one game piece; means for raising and rotating the self-loading bin upon initialization of the game apparatus; a moveable claw for grabbing the at least one game piece; first controller operatively connected to the bin and claw, the first controller stopping rotation of the bin and activating the moveable claw; a catapult for launching the at least one game piece; a second controller operatively connected to the catapult, the second controller positioning the catapult; a third controller operatively connected to the catapult, the third controller activating the catapult to thereby launch the at least one game piece; and a target area for receiving the at least one game piece; wherein the moveable claw places the at least one game piece on the catapult, and wherein the catapult launches the at least one game piece at the target area.

In this embodiment of the apparatus the first controller is a load button mechanism, the second controller is a joystick mechanism, and the third controller is a launch button mechanism. The apparatus further comprises a means for changing strength operatively connected to the catapult, the means for changing strength periodically changing the strength of the catapult between at least minimum and maximum values.

At least one of the minimum and maximum values are adjustable. The target area has a predetermined opening. The target area may be adjustable, moveable, or have a predetermined opening with a moveable-blocking member positioned relative to the opening such that the opening alternates between being blocked and unblocked by the blocking member.

The bin may automatically rise until the at least one game piece is at a predetermined height. For this the bin has a means for sensing game pieces and a means for raising the game pieces to a predetermined height, the means for sensing being operatively connected to the means for rising.

The claw mechanism moves along a half-moon path between the bin and the catapult. The claw mechanism is structured to grasp at least one game piece and deposit the at least one game piece on a predetermined part of the catapult. The at least one game piece may be a prize that is dispensed by the apparatus when the at least one game piece engages the target area.

Another embodiment is method of playing a game of skill having a plurality of game pieces and having a target area, comprising the steps of: selecting at least one of the game pieces at a first location; moving the selected game piece to a second location; and catapulting the at least one of the game pieces from the second location toward a target area. The step of selecting may comprise the steps of rotating a plurality of game pieces, selectively stopping rotation of the plurality of game pieces, and picking up at least one of the game pieces. The step of catapulting may comprise the steps of aiming the, catapult toward a target area and launching the at least one of the game pieces toward the target area.

In a further embodiment the method of playing a game of skill, comprises the steps of: rotating a plurality of game pieces; selectively stopping rotation of the plurality of game pieces; picking up at least one of the game pieces; moving the at least one of the game pieces to a catapult; placing the at least one of the game pieces on the catapult; aiming the catapult toward a target area; and launching the at least one of the game pieces toward the target area.

The method may also comprise, while the at least one of the game pieces is on the catapult, periodically changing the strength of the catapult between at least minimum and maximum values. At least one of the minimum and maximum values are adjustable. The method may further comprise automatically raising the plurality of game pieces in the bin until the plurality of game pieces is at a predetermined height.

The method may further comprise moving the target area at least while the at least one of the game pieces is on the catapult. The method may further comprise periodically blocking the target area at least while the at least one of the game pieces is on the catapult. The method may further comprises returning the at least one of the game pieces to the plurality of game pieces when the at least one of the game pieces misses the target area, and providing the at least one of the game pieces as a prize when the at least one of the game pieces engages the target area.

Another embodiment is a method of playing a game of skill, comprising the steps of: rotating a plurality of game pieces; selectively stopping rotation of the plurality of game pieces; picking up at least one of the game pieces with a claw mechanism; moving the claw mechanism such that the at least one of the game piece is positioned substantially over a predetermined portion of a catapult; activating the claw mechanism to release the at least one of the game pieces such that the at least one of the game nieces drops onto the predetermined portion of the catapult; aiming the catapult toward a target area; and launching the at least one of the game pieces toward the target area.

It is to be understood, of course, that the present invention in various embodiments can be implemented in hardware, software, or in combinations of hardware and software.

The present invention is not limited to the particular details of the apparatus and method depicted, and other modifications and applications are contemplated. Certain other changes may be made in the above-described apparatus and method without departing from the true spirit and scope of the invention herein involved. It is intended, therefore, that the subject matter in the above depiction shall be interpreted as illustrative and not illuminating sense.

What is claimed is:

1. A game apparatus, comprising:

a rotating bin containing at least one game piece;

a moveable claw for grabbing the at least one game piece;

a catapult for launching the at least one game piece; and a target area for receiving the at least one game piece;

wherein the moveable claw places the at least one game piece on the catapult, and wherein the catapult launches the at least one game piece at the target area.

2. The apparatus according to claim 1, wherein the apparatus further comprises a means for changing strength operatively connected to the catapult, the means for changing strength periodically changing a strength of the catapult between at least minimum and maximum values.

3. The apparatus according to claim 2, wherein at least one of the minimum and maximum values are adjustable.

4. A game apparatus for use with at least one game piece and a target area, comprising:

means for containing the at least one game piece;

means for at least rotating the means for containing;

means for grabbing the at least one game piece;

means for catapulting the at least one game piece toward the target area;

means for moving the means for grabbing from the means for containing to the means for catapulting;

means for activating the means for grabbing such that the at least one game piece is released onto the catapult; and means for positioning the means for catapulting and means for activating the catapult such that the at least one game piece is catapulted toward the target area.

5. A skill game apparatus, comprising:

a self-loading bin containing at least one game piece;

means for raising and rotating the self-loading bin upon initialization of the game apparatus;

a moveable claw for grabbing the at least one game piece;

first controller operatively connected to the bin and claw, the first controller stopping rotation of the bin and activating the moveable claw;

a catapult for launching the at least one game piece;

a second controller operatively connected to the catapult, the second controller positioning the catapult;

a third controller operatively connected to the catapult, the third controller activating the catapult to thereby launch the at least one game piece; and a target area for receiving the at least one game piece;

wherein the moveable claw places the at least one game piece on the catapult, and wherein the catapult launches the at least one game piece at the target area.

6. The apparatus according to claim 5, wherein the first controller is a load button mechanism.

7. The apparatus according to claim 5, wherein the second controller is a joystick mechanism.

8. The apparatus according to claim 5, wherein the third controller is a launch button mechanism.

9. The apparatus according to claim 5, wherein the target area has a predetermined opening.

10. The apparatus according to claim 5, wherein the target area is adjustable.

11. The apparatus according to claim 5, wherein the target area is moveable.

12. The apparatus according to claim 5, wherein the target area has a predetermined opening, and has a moveable blocking member positioned relative to the opening such that the opening alternates between being blocked and unblocked by the blocking member.

13. The apparatus according to claim 5, wherein the bin automatically raises until the at least one game piece is at a predetermined height.

14. The apparatus according to claim 5, wherein the bin has a means for sensing game pieces and a means for raising the game pieces to a predetermined height, the means for sensing being operatively connected to the means for raising.

15. The apparatus according to claim 5, wherein the claw mechanism moves along a half-moon path between the bin and the catapult, and wherein the claw mechanism is structured to grasp at least one game piece and deposit the at least one game piece on a predetermined part of the catapult.

16. The apparatus according to claim 5, wherein the at least one game piece is a prize that is dispensed by the apparatus when the at least one game piece engages the target area.

17. A method of playing a game of skill having a plurality of game pieces and having a target area, comprising the steps of:

selecting at least one of the game pieces at a first location;

moving the selected game piece to a second location; and catapulting the at least one of the game pieces from the second location toward a target area.

18. The method according to claim 17, wherein the step of selecting comprises the steps of rotating a plurality of game pieces, selectively stopping rotation of the plurality of game pieces, and picking up at least one of the game pieces.

19. The method according to claim 17, wherein the step of catapulting comprises the steps of aiming the catapult toward a target area and launching the at least one of the game pieces toward the target area.

20. A method of playing a game of skill, comprising the steps of:

rotating a plurality of game pieces within a bin;

selectively stopping rotation of the plurality of game pieces;

picking up at least one of the game pieces;

moving the at least one of the game pieces to a catapult;

placing the at least one of the game pieces on the catapult;

aiming the catapult toward a target area; and launching the at least one of the game pieces toward the target area.

21. The method according to claim 20, wherein the method further comprises, while the at least one of the game pieces is on the catapult, periodically changing the strength of the catapult between at least minimum and maximum values.

22. The method according to claim 21, wherein at least one of the minimum and maximum values are adjustable.

23. The method according to claim 20, wherein the method further comprises automatically raising the plurality of game pieces in the bin until the plurality of game pieces is at a predetermined height.

24. The method according to claim 20, wherein the method further comprises moving the target area at least while the at least one of the game pieces is on the catapult.

25. The method according to claim 20, wherein the method further comprises periodically blocking the target area at least while the at least one of the game pieces is on the catapult.

26. The method according to claim 20, wherein the method further comprises returning the at least one of the game pieces to the plurality of game pieces when the at least one of the game pieces misses the target area, and providing the at least one of the game pieces as a prize when the at least one of the game pieces engages the target area.

27. A method of playing a game of skill, comprising the steps of:

rotating a plurality of game pieces;

selectively stopping rotation of the plurality of game pieces;

picking up at least one of the game pieces with a claw mechanism;

moving the claw mechanism such that the at least one of the game piece is positioned substantially over a predetermined portion of a catapult;

activating the claw mechanism to release the at least one of the game pieces such that the at least one of the game pieces drops onto the predetermined portion of the catapult;

aiming the catapult toward a target area; and launching the at least one of the game pieces toward the target area.

* * * * *